US006422390B1

(12) United States Patent
Humphrey

(10) Patent No.: US 6,422,390 B1
(45) Date of Patent: Jul. 23, 2002

(54) SELF SUPPORTING LIGHTING FIXTURE AND PACKAGE THEREFORE

(75) Inventor: Neall W. Humphrey, El Dorado Hills, CA (US)

(73) Assignee: Trade Source International, El Dorado Hills, CA (US)

( * ) Notice: Subject to any disclaimer, the term of this patent is extended or adjusted under 35 U.S.C. 154(b) by 0 days.

(21) Appl. No.: 09/689,180

(22) Filed: Oct. 11, 2000

(51) Int. Cl.[7] ..... B65D 85/62
(52) U.S. Cl. ..... 206/500; 206/421; 206/521
(58) Field of Search ..... 206/521, 500, 206/418, 421, 562, 486

(56) References Cited

U.S. PATENT DOCUMENTS

| | | | | | |
|---|---|---|---|---|---|
| RE13,465 | E | * | 9/1912 | Morton | 206/500 |
| 1,059,359 | A | * | 4/1913 | Hahn | 206/500 |
| 1,146,515 | A | * | 7/1915 | Potter | 206/500 |
| 1,625,620 | A | * | 4/1927 | Maston | 206/500 |
| 1,800,841 | A | * | 4/1931 | Maston | 206/500 |
| 3,064,402 | A | | 11/1962 | Crane, Jr. | |
| 4,285,432 | A | * | 8/1981 | De Villers et al. | 206/500 |
| 6,176,378 | B1 | * | 1/2001 | Truscello et al. | 206/521 |

FOREIGN PATENT DOCUMENTS

| | | | | | |
|---|---|---|---|---|---|
| GB | 2165527 | A | * | 4/1986 | 206/500 |

* cited by examiner

*Primary Examiner*—Bryon P. Gehman
(74) *Attorney, Agent, or Firm*—Oppenheimer Wolff & Donnelly LLP

(57) ABSTRACT

A self supporting lighting fixture and package therefore comprising a package having a top wall spaced from a bottom wall, a hole in the top wall aligned with a hole in the bottom wall and a pair of spaced peripheral side walls interconnecting the top and bottom walls on opposite sides of the package. The package is open adjacent each side wall so that the inner contents can be viewed. A lighting fixture is disposed in the package having a bottom portion resting on the package bottom wall and an integral upper portion extending through the opening in the top wall and out of the package.

17 Claims, 7 Drawing Sheets

SELF SUPPORTING LIGHTING FIXTURE AND PACKAGE THEREFORE

BACKGROUND OF THE INVENTION

The invention relates to lighting fixture package design; and, more particularly, to a free standing self supporting lighting fixture and package therefore.

BACKGROUND INFORMATION

Various packages are known in the art for supporting items on a shelf or the like. Such packages should display the item yet allow the same to be self supported in an upright position on a shelf or the like.

SUMMARY OF THE INVENTION

It is an object of this invention to provide a self supporting lighting fixture and package therefore for mounting on a shelf or the like in an upright position.

It is another object of this invention to provide such a package which grips the body of the lighting fixture.

These and other objects are preferably accomplished by providing a housing having an apertured base wall upon which the wide base of lighting fixture rests and an apertured open top wall, spaced from the base wall, through which the narrower top of the lighting fixture extends. The opening in the top wall surrounds the tapered peripheral wall of the lighting fixture between its top and bottom. The housing has a pair of oppositely spaced side walls interconnecting the top and bottom walls, the housing being open on each side of the spaced side walls.

One unit can be stacked on top of another without breakage and saving of space.

DESCRIPTION OF THE PREFERRED EMBODIMENT

Figure 1:
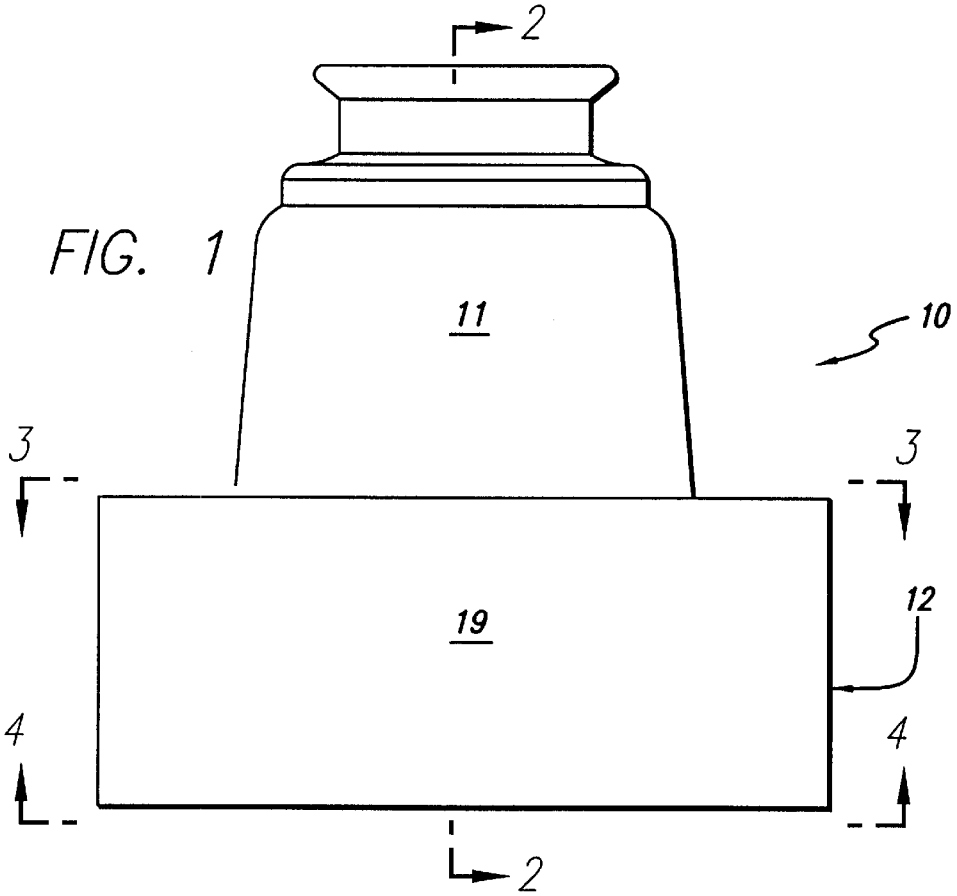
FIG. 1 is a side elevational view of a display package and lighting fixture in accordance with the teachings of the invention, the opposite side being a mirror image thereof.

Referring now to FIG. 1 of the drawing, a package and lighting fixture unit 10 is shown having a lighting fixture 11 mounted in a package 12. Lighting fixture 11 is generally bell-shaped (FIG. 2) having a narrow open top 13, flat bottom wall 14 and a tapered peripheral wall 15 interconnecting top 13 and bottom wall 14. Fixture 11 may be a glass housing enclosing a bulb.

Package 12 (FIG. 2) has a flat bottom wall 16, a flat top wall 17 spaced from bottom wall 16, a first side wall 18 integral with side wall 19 and bottom wall 16, side wall 19 being opposite first side wall 18 and spaced therefrom, and integral with top wall 17 and bottom wall 16. Side wall 18 is also integral with an upper flap portion 20. which underlies top wall 17. The overlapping top wall 17 and flap portion 20 form an upper enclosure for package 12. Package 12 is open on the sides adjacent side walls 18, 19 (see opening 21 in FIG. 2) extending through package 12 so that the fixture 11 mounted inside package 12 can be viewed.

Figure 2:
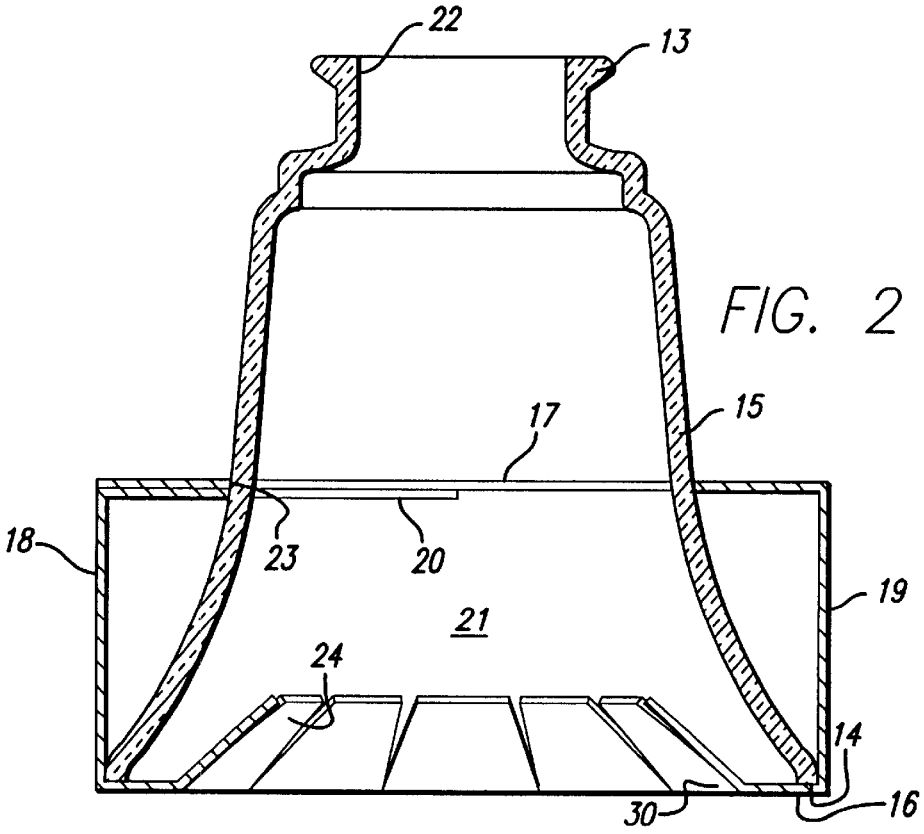
FIG. 2 is a view of the package and lighting fixture of FIG. 1 taken along lines 2—2 hereof.

Opening 22 at the top of fixture 11 can be seen in FIG. 2.

Figure 3:
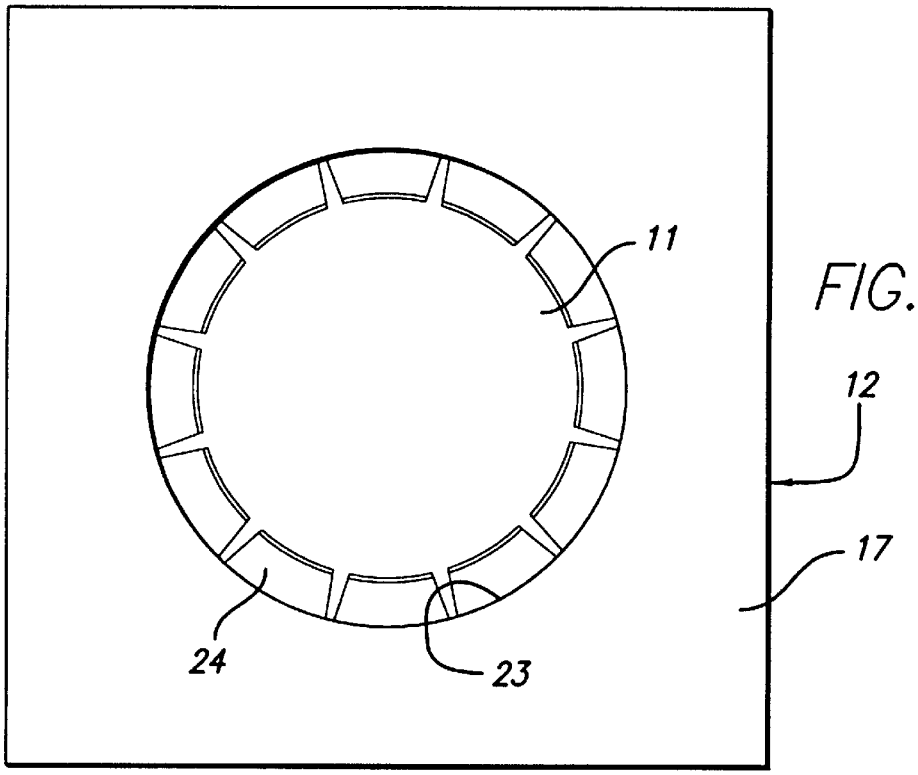
FIG. 3 is a view taken along lines 3—3 of FIG. 1.
Figure 4:
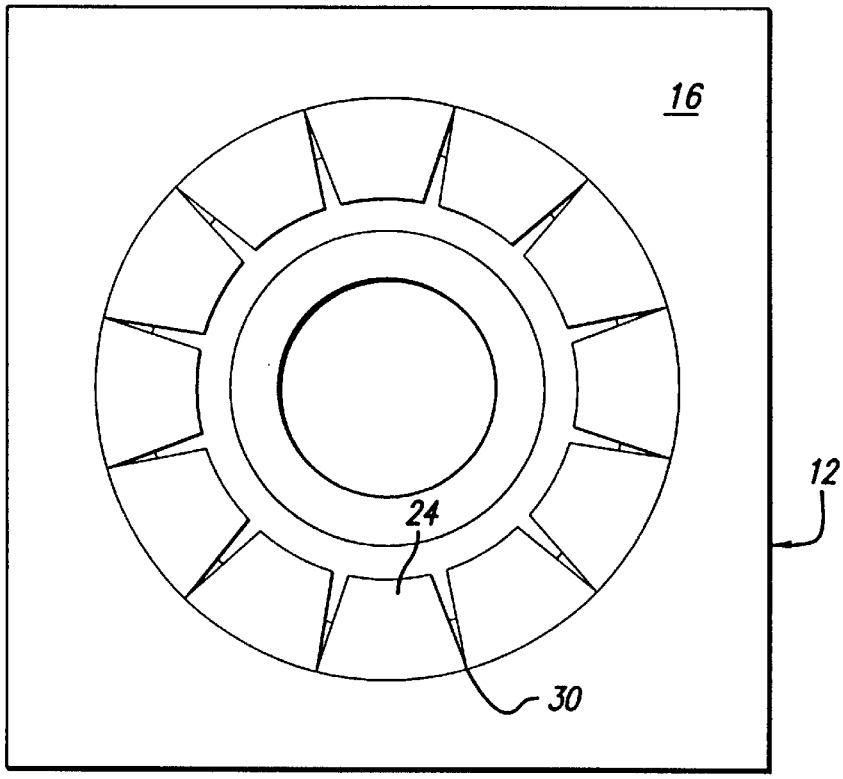
FIG. 4 is a view taken along lines 4—4 of FIG. 1.

It can be seen in FIG. 3 (the fixture 11 removed for convenience of illustration) that there is a cut-out opening 23 in top wall 17 through which fixture 11 extends (see also FIG. 2). A plurality of spaced hinged flaps 24 extend peripherally about an opening 30 (FIG. 4) through bottom wall 16 (see FIG. 4) extending inwardly providing a protective ring about fixture 11 when it is mounted in package 12 as will be discussed (see FIG. 6).

Figure 6:
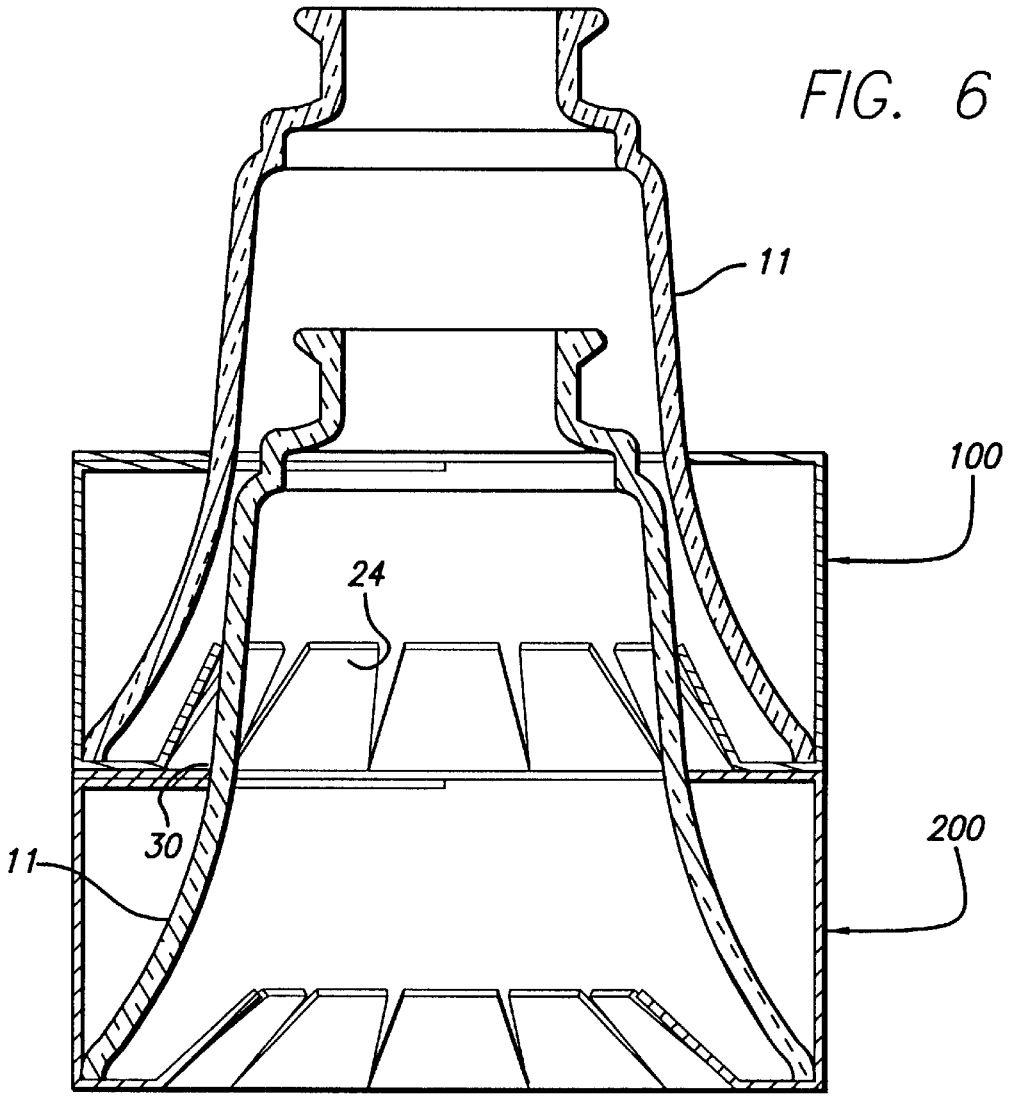
FIG. 6 is an elevational view of 2 units, one stacked on top of the other.
Figure 5:
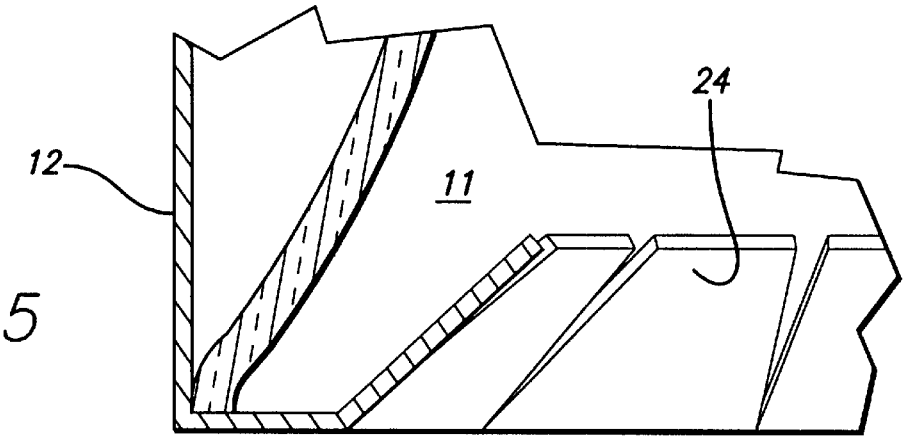
FIG. 5 is a detailed view of a portion of the unit of FIG. 2 taken along line 5.

As seen in FIG. 5, these flaps 24 also protect the fixture when one is stacked on top of another. As seen in FIG. 6, a first unit 100 is stacked on top of a second unit 200. Like numerals in FIGS. 1 to 5 refer to like numerals of each unit 100, 200 (which are identical). Thus, the fixture 11 of unit 200 has its upper portion extending through the opening 30 in the bottom wall 16 of upper unit 100. Flaps 24 in the upper unit 100 overlie fixture 11 in the lower unit 200, as seen, and protects the fixture from breakage or chipping. Storage space is saved by stacking one unit on top of the other (or a plurality of units).

Figure 7:
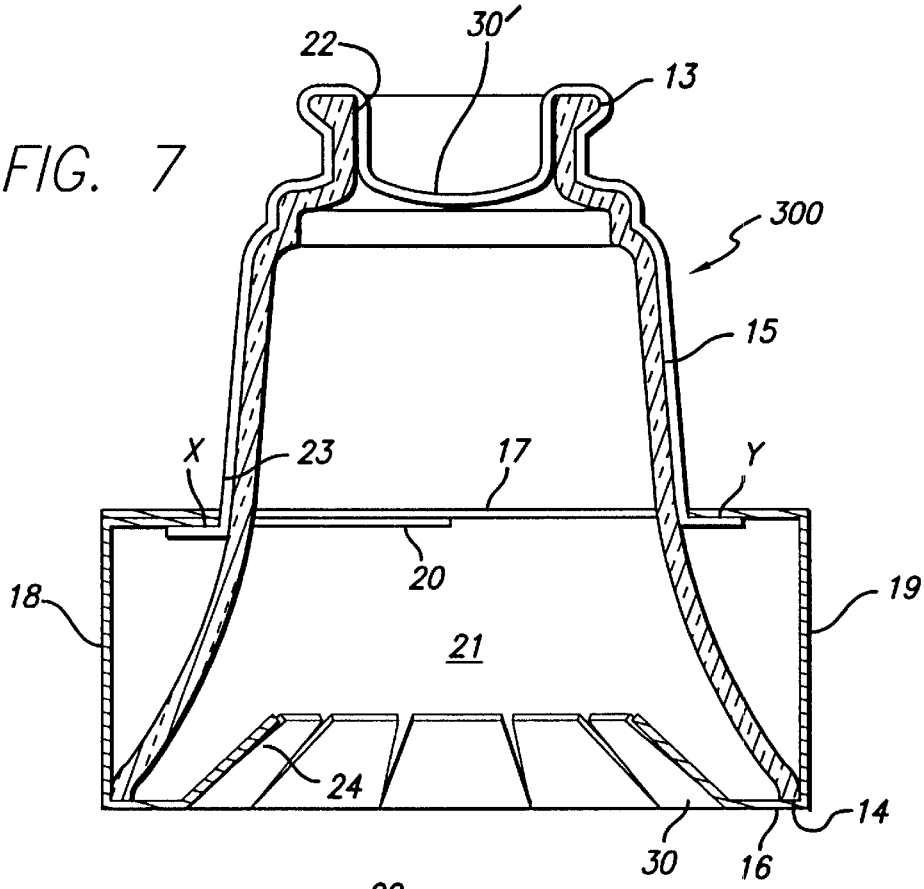
FIG. 7 is a view similar to FIG. 2 illustrating wrapping of the glass fixture.

As seen in FIG. 7, wherein like numerals refer to like parts of FIG. 2, the upper exposed portion of fixture 11 may be covered with a clear transparent film, such as Saran® wrap, a tough flexible thermoplastic resin material, or a rigid plastic blister material 300. Material 300 sags in a top in area 30' and secured to the underside of flap portion 20 and top wall 17 at points x' and y', respectively, in any suitable manner, such as taping or gluing. Alternatively, material 300 may be secured elsewhere to package 12.

Figure 8:
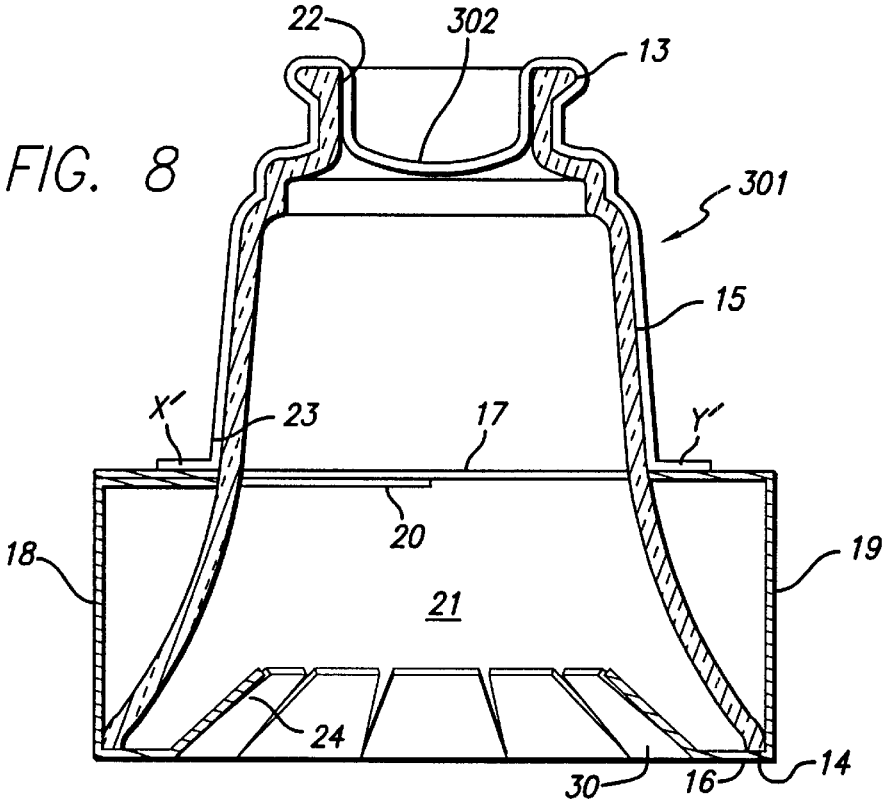
FIG. 8 is a view similar to FIG. 7 illustrating another type of wrapping of the glass fixture.

As seen in FIG. 8, wherein like numerals refer to like parts of FIG. 2, the upper exposed portion of fixture 11 may be covered with a clear transparent film, such as Saran ® wrap, a tough flexible thermoplastic resin material, or a rigid plastic blister material 301'. Material 301 sags in a top in area 302 and is secured to the top side of flap portion 20 and top wall 17 at points x' and y', respectively, in any suitable manner, such as taping of gluing.

Figure 9:
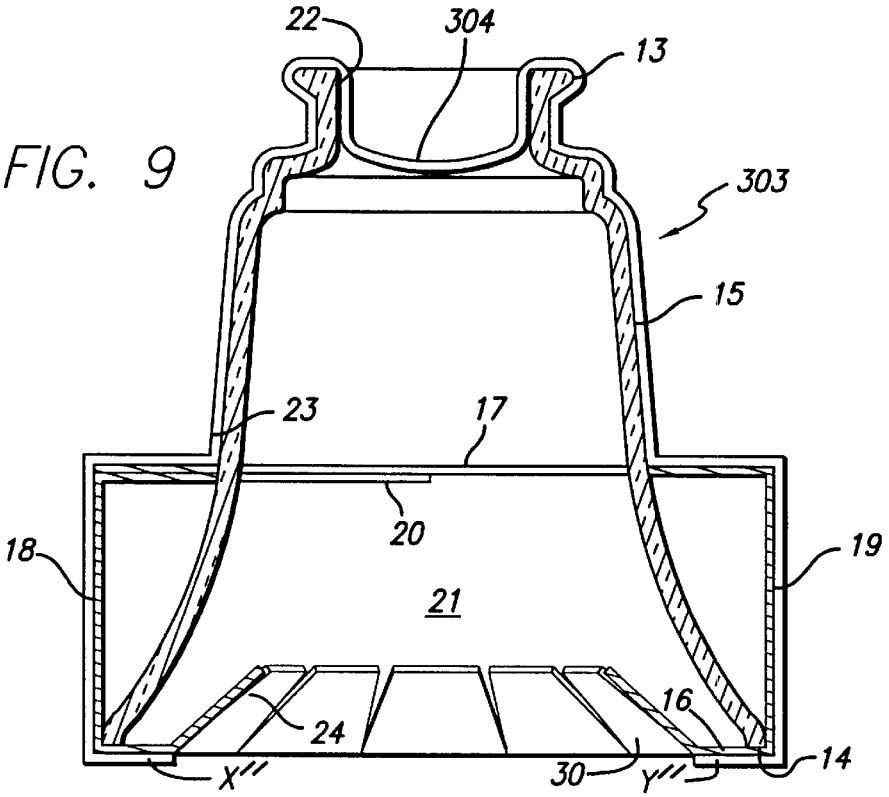
FIG. 9 is a view similar to FIG. 7 illustrating still another type of wrapping of the glass fixture.

As seen in FIG. 9, wherein like numerals refer to like parts of FIG. 2, the upper exposed portion of fixture 11 may be covered with a clear transparent film, such as Saran ® wrap, a tough flexible thermoplastic resin material, or a rigid plastic blister material 303. Material 303 sags in a top in area 304 and extends all the way around the outside of the bottom portion of package 12 along the underside of bottom wall 16 and is secured thereto at points x" and y", respectively, in any suitable manner, such as taping or gluing. Alternatively, material 300 may be secured elsewhere to package 12.

Figure 10:
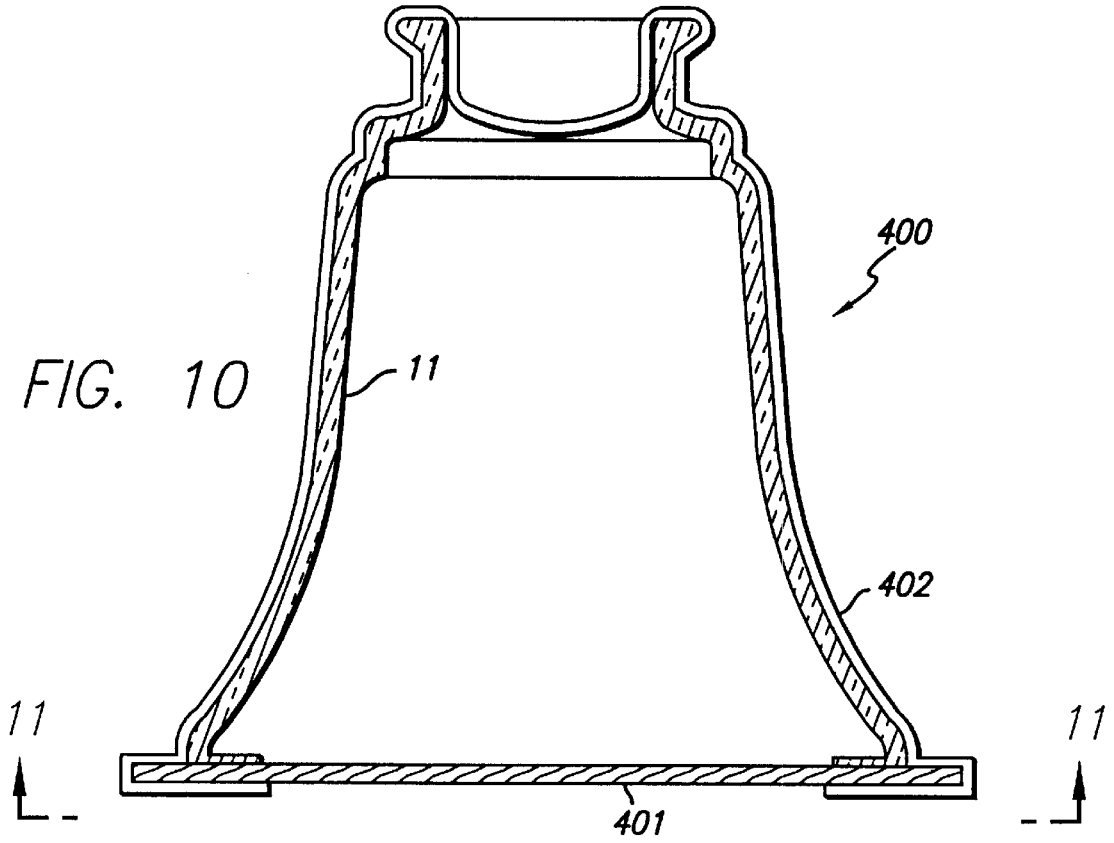
FIG. 10 is an elevational sectional view of another embodiment of this invention.
Figure 11:
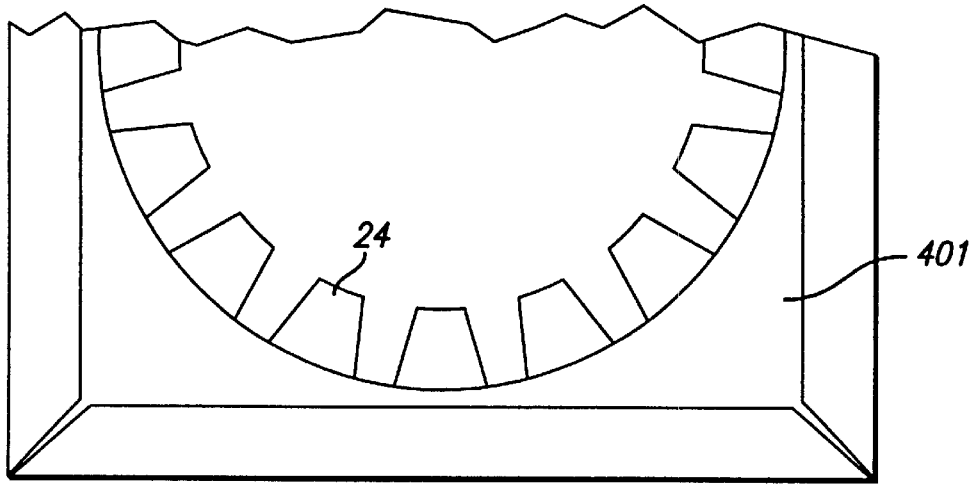
FIG. 11 is a view taken along lines 11—11 of FIG. 10.

Referring now to FIG. 10, still another embodiment is shown wherein like numerals refer to like parts of the embodiment of FIGS. 1 and 2. The package 400 includes a fixture 11 disposed on top of a rectangular piece of cardboard panel 401 having flaps 24 as seen in FIG. 11. The fixture 11 and panel 401 is then covered by a film 402 of a tough flexible thermoplastic resin material or a plastic blister material. One of the packages 400 can be stacked on top of another, the covered top of one fixture extending into the opening in the bottom 401 of the other fixture as in FIG. 6.

Figure 12:
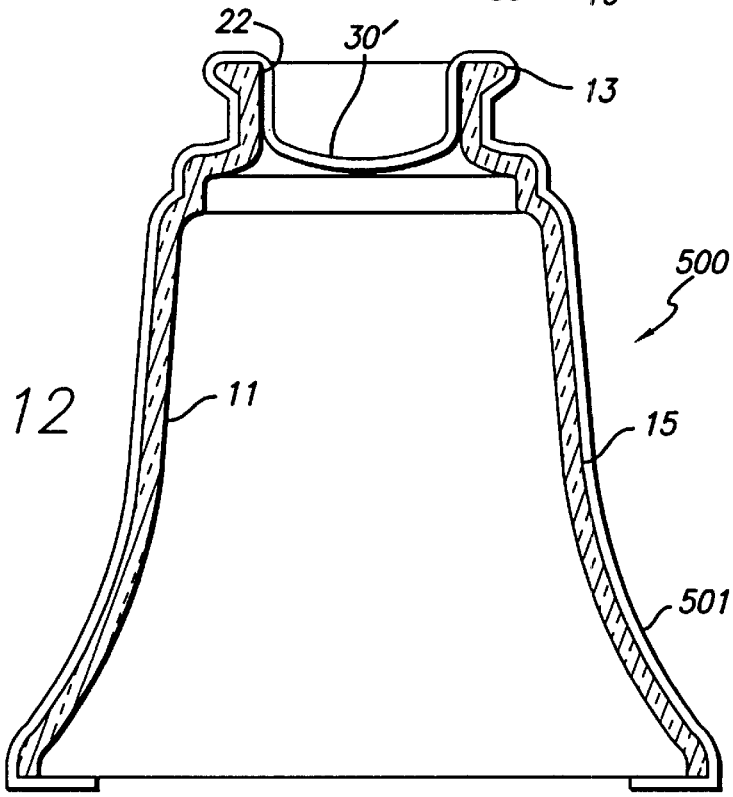
FIG. 12 is an elevational sectional view of still another embodiment of the invention.

FIG. 12 is still another embodiment of a package 500 wherein like numerals refer to like parts of the embodiment of FIGS. 1 and 2. A film of a tough flexible thermoplastic resin material 501 or a plastic blister material surrounds the entire fixture 11. One of the fixtures 11 in FIG. 12 can be stacked on top of another.

Figure 13:
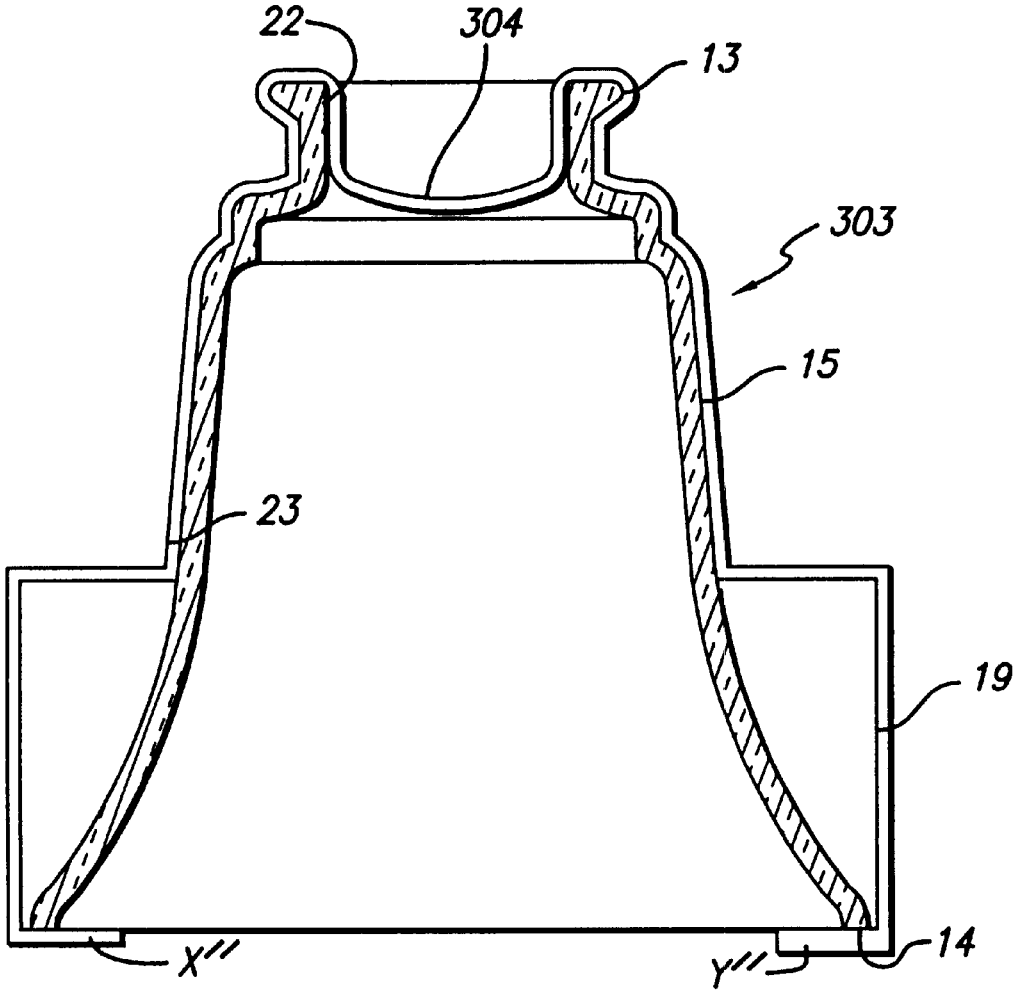
FIG. 13 is an elevational sectional view similar to FIG. 9 of another embodiment of the invention.

As seen in FIG. 13, the package 19 of FIG. 9 can be eliminated (like numerals refer to like parts of FIG. 9) and the fixture and package 303 can be wrapped in a suitable clear transparent film 304, such as Saran® wrap, which retains its shape about the bottom of the fixture 15 (forming, in effect, a box-like support). Thus, the package for the embodiment in FIG. 3 is the plastic wrap itself which holds its shape forming spaced top, bottom and side walls similar to package 19 in FIG. 9.

Any suitable materials may be used. The lighting fixture is generally of glass or plastic; the package may be made of cardboard, plastic, etc. Cardboard is preferred since flaps 24 may be easily cutout of the peripheral portion of bottom wall 16 surrounding opening 30.

Although a particular embodiment of the invention is disclosed, variations thereof may occur to an artisan and the scope of the invention should be limited only by the scope of the appended claims.

What is claimed is:

1. A self supporting lighting fixture and package therefore comprising:

a package having a top wall, a bottom wall spaced from the top wall and a pair of spaced side walls interconnecting the top and bottom walls, the package being open on the sides thereof adjacent each of said spaced side walls forming a through passage through said package;

a first opening in said top wall and a second opening in said bottom wall, said openings being aligned and said opening through said top wall being lesser in diameter than the opening through said bottom wall;

a lighting fixture mounted in said package having a lower portion resting on said bottom wall and confined between said spaced side walls, said fixture further having a top portion extending out of the opening in said top wall and therethrough, said lower portion of said fixture being integrally connected to said top portion by a tapered peripheral side wall portion, said lighting fixture being open therethrough from the top to bottom thereof having a rim at both its upper end and its lower end, said flaps extending upwardly from said bottom wall about the rim of said lower portion of said lighting fixture; and a second lighting fixture and package identical to the first mentioned lighting fixture and package being stacked on top of said first mentioned lighting fixture and package, the upper portion of the fixture of said first mentioned lighting fixture and package extending through and into the open bottom portion of the fixture of said second mentioned lighting fixture and package.

2. The lighting fixture and package of claim 1 including a plurality of hinged flaps surrounding the opening in said bottom wall.

3. The lighting fixture and package of claim 2 wherein said lighting fixture is open therethrough from the top to bottom thereof having a rim at both its upper end and its lower end, said flaps extending upwardly from said bottom wall about the rim of said lower portion of said lighting fixture.

4. The lighting fixture and package of claim 3 wherein a second lighting fixture and package identical to the first mentioned lighting fixture and package is stacked on top of said first mentioned lighting fixture and package, the upper portion of the fixture of said first mentioned lighting fixture and package extending through and into the open bottom portion of the fixture of said second mentioned lighting fixture and package.

5. The lighting fixture and package of claim 1 wherein the flaps of said second mentioned lighting fixture and package surround the tapered portion of the fixture of said first mentioned lighting fixture and package.

6. The lighting fixture and package of claim 5 wherein said package is of cardboard.

7. The lighting fixture and package of claim 6 wherein said flap s are portions cutout of said cardboard.

8. The lighting fixture and package of claim 1 wherein said package is of cardboard.

9. The lighting fixture and package of claim 8 wherein said flaps are portions cutout of said cardboard.

10. A self supporting light fixture and package therefore comprising:

a package having a top wall, a bottom wall spaced from the top wall and at least a pair of spaced side walls interconnecting the top and bottom walls;

a first opening in said top wall and a second opening in said bottom wall, said openings aligned and said opening through said top wall being lesser in diameter than the opening through said bottom wall;

a lighting fixture mounted in said package having a lower portion resting on said bottom wall and confined between said spaced side walls, said fixture further having a top portion extending out of the opening in said top wall and therethrough, said lower portion of said fixture being integrally connected to said top portion by a tapered peripheral side wall portion; and purality of hinged flaps surrounding the opening in said bottom wall, said lighting fixture being open therethrough from the top to bottom thereof and having a rim at both its upper end and its lower end, said flaps extending upwardly from said bottom wall about the rim of said lower portion of said lighting fixture but spaced therefrom in a non-contiguous relationship.

11. A lighting fixture and package of claim 10 wherein the exposed top portion of said lighting fixture is covered by a film of transparent material.

12. The lighting fixture and package of claim 11 wherein said film is a tough flexible thermoplastic resin material.

13. The lighting fixture and package of claim 11 wherein said film is a rigid plastic blister material.

14. The lighting fixture and package of claim 11 wherein said film extends about the bottom of said fixture forming said top wall, said bottom wall and said spaced top walls.

15. The lighting fixture and package of claim 11 wherein said film extends about the upper surface of said lighting fixture to said package, about said package and under the bottom wall of said package where it is secured thereto.

16. The lighting fixture and package of claim 11 wherein said film extends about the top portion of said lighting fixture, along the tapered peripheral sidewall portion thereof into said package and below the top wall of said package and secured thereto.

17. The lighting fixture and package of claim 1X; wherein said film extends about top portion of said lighting fixture, along the tapered peripheral side wall portion thereof and on top of the top wall of said package and secured thereto.

* * * * *